US007300253B2

(12) United States Patent
Beeck et al.

(10) Patent No.: US 7,300,253 B2
(45) Date of Patent: Nov. 27, 2007

(54) GAS TURBINE BLADE OR VANE AND PLATFORM ELEMENT FOR A GAS TURBINE BLADE OR VANE RING OF A GAS TURBINE, SUPPORTING STRUCTURE FOR SECURING GAS TURBINE BLADES OR VANES ARRANGED IN A RING, GAS TURBINE BLADE OR VANE RING AND THE USE OF A GAS TURBINE BLADE OR VANE RING

(75) Inventors: Alexander Ralph Beeck, Orlando, FL (US); Stefan Irmisch, Jupiter, FL (US)

(73) Assignee: Siemens Aktiengesellschaft, Munich (DE)

( * ) Notice: Subject to any disclaimer, the term of this patent is extended or adjusted under 35 U.S.C. 154(b) by 106 days.

(21) Appl. No.: 11/214,303

(22) Filed: Aug. 29, 2005

(65) Prior Publication Data

US 2007/0020102 A1 Jan. 25, 2007

Related U.S. Application Data

(60) Provisional application No. 60/702,358, filed on Jul. 25, 2005.

(51) Int. Cl.
*F01D 5/30* (2006.01)

(52) U.S. Cl. ..... 416/193 A; 416/196 R; 416/219 R

(58) Field of Classification Search ..... 416/193 A, 416/196 R, 204 A, 219 R, 220 R, 241 B
See application file for complete search history.

(56) References Cited

U.S. PATENT DOCUMENTS 5,435,693 A * 7/1995 Shaffer ..... 416/204 A
6,726,452 B2 * 4/2004 Strassberger et al. ..... 416/190
6,739,837 B2 * 5/2004 Barnette et al. ..... 416/220 R

FOREIGN PATENT DOCUMENTS

WO WO 01/59263 A2 8/2001

* cited by examiner

*Primary Examiner*—Edward K. Look
*Assistant Examiner*—Dwayne J White

(57) ABSTRACT

The invention relates to a gas turbine blade or vane ring having a supporting structure and gas turbine blades or vanes secured to it. The gas turbine blades or vanes have a blade or vane root, which is successively adjoined by a platform and then a blade profile which is curved in the longitudinal direction, the blade or vane root running in the longitudinal direction of the blade profile, and the platform having two platform longitudinal edges which are bent parallel and run in the longitudinal direction. To provide an alternative gas turbine blade or vane ring with simplified assembly, it is proposed that the blade or vane root be shaped in such a manner that the suction-side or pressure-side blade or vane root surface of the associated platform longitudinal edge be curved convexly or concavely, respectively. Moreover, the invention relates to the use of a gas turbine blade or vane ring of this type.

15 Claims, 3 Drawing Sheets

GAS TURBINE BLADE OR VANE AND PLATFORM ELEMENT FOR A GAS TURBINE BLADE OR VANE RING OF A GAS TURBINE, SUPPORTING STRUCTURE FOR SECURING GAS TURBINE BLADES OR VANES ARRANGED IN A RING, GAS TURBINE BLADE OR VANE RING AND THE USE OF A GAS TURBINE BLADE OR VANE RING

CROSS REFERENCE TO RELATED APPLICATION

This application claims the benefit of U.S. Provisional Patent Application Ser. No. 60/702,358, filed Jul. 25, 2005.

FIELD OF THE INVENTION

The invention relates to a gas turbine blade or vane having a blade or vane root which is profiled in cross section and is successively adjoined by a platform and then a blade profile which is curved in the longitudinal direction, the blade or vane root running in the longitudinal direction of the blade profile, and the platform having two platform longitudinal edges which are bent parallel and run in the longitudinal direction. Furthermore, the invention relates to a platform element for a gas turbine blade or vane ring of a gas turbine, having a profiled platform root and a platform plate, which has two bent longitudinal edges and in which the platform plate and the platform root extend in a longitudinal direction. Moreover, the invention relates to a supporting structure for securing gas turbine blades or vanes arranged in a ring, in which supporting structure there are blade or vane holding grooves, into each of which the blade or vane root of the gas turbine blade or vane can be inserted. Moreover, the invention relates to a gas turbine blade or vane ring for a gas turbine having a supporting structure and having gas turbine blades or vanes, and to the use of a gas turbine blade or vane ring of this type.

BACKGROUND OF THE INVENTION

The prior art has disclosed gas turbine blades or vanes with purely rectilinear blade or vane roots and platforms as well as curved blade profiles. The pressure-side platform and the suction-side platform have greatly varying platform overhangs along their blade profile. By way of example, on the pressure side, in the middle region between the leading edge and trailing edge, gas turbine blades or vanes of this type have large overhangs which diminish steadily toward the leading edge and trailing edge. These large overhangs are difficult to cool and/or cannot be adequately cooled and reduce the fatigue strength of the gas turbine blade or vane.

To avoid these platform overhangs, WO 2001/059263 A2 has disclosed a turbine blade or vane arrangement for a gas turbine. The gas turbine rotor blade, which has a rectilinear blade root, is inserted in a positively locking manner in a holding groove which is provided at the outer circumference of a turbine disk. The gas turbine rotor blades only have platform stubs, the longitudinal edges of which are curved in the axial direction of the turbine. A separate platform is connected to the turbine disk between two adjacent gas turbine rotor blades by means of an additional holding means. It is possible to radially lengthen the blade profiles on account of the relatively light weight of the gas turbine blade resulting from the absence of a platform.

One drawback in this respect is that each platform element has to be secured to the turbine disk by means of a separate holding element or a separate holding means.

SUMMARY OF THE INVENTION

It is an object of the invention to provide a simplified system for securing gas turbine blades or vanes to a supporting structure to form a gas turbine blade or vane ring for a gas turbine. A further object of the invention is the use of a gas turbine blade or vane ring according to the invention.

The object relating to the system is achieved by providing a gas turbine blade or vane ring having the features of the claims. The simplified system is composed at least of a supporting structure as claimed in the claims, to which gas turbine blades or vanes as claimed in the of claims are secured. Accordingly, the solution also requires a supporting structure, in which there are blade or vane holding grooves shaped in a corresponding manner to the blade or vane root of the gas turbine blade or vane.

The invention is based on the discovery that the platform and the blade or vane root of the gas turbine blade or vane, as well as the holding grooves of the supporting structure, have to be shaped in the same way in the longitudinal direction or axial direction, in order to achieve particularly simple, even individual, assembly of the gas turbine blades or vanes. In the quoted prior art, however, these shapes are different: the platform longitudinal edges are curved in the axial direction, whereas the blade or vane root is rectilinear in the axial direction. Since the known gas turbine blade or vane, on account of the rectilinear blade or vane root, is pushed in by a purely translational movement, and its platform longitudinal edges are curved, the platform elements located in between have to be introduced radially into their operating position in order then to be secured to the rotor disk by means of an additional holding means which is fitted in a rectilinear direction of movement.

By contrast, the invention proposes that the blade or vane root be shaped in such a manner that the blade or vane root surface which respectively faces the suction-side profile wall and pressure-side profile wall be respectively convexly or concavely curved, in accordance with the platform longitudinal edges. All the geometric surfaces which influence assembly are then curved in the same direction, so that all the components which form the gas turbine blade or vane ring can be fitted together individually in a direction of movement corresponding to their curvature.

Complying with this geometric condition also makes it possible to provide gas turbine blades or vanes having a pressure-side platform and a suction-side platform, which each have an approximately equal platform width as platform overhang along the profile wall. The platform width is the distance from the pressure-side or suction-side profile wall to the closest platform longitudinal edge.

The approximately constant platform width allows significantly simpler and more efficient cooling of the platform. During use in a gas turbine, this leads to a more uniform temperature distribution, which in turn lengthens the service life of the gas turbine, on account of the reduced material stresses.

The design is subject to the condition that the gas turbine blades or vanes and, if necessary, platform elements have to be suitable for displacement, i.e. assembly, into the supporting structure in the axial direction, based on their installation position in the gas turbine. For this situation, the platform width which is constant along the blade profile is only possible with a blade or vane root which is curved in the same way as the blade profile. In the case of gas turbine blades or vanes with a rectilinear blade or vane root and a curved platform longitudinal edge—as in the cited prior art—the transition region between the straight blade or vane root and the curved platform must perform a certain geometric adjustment. In operation, the occurring forces and the mechanical and thermal loads have to be dissipated. This is not the case with the gas turbine blade or vane according to the invention. Moreover, it is possible to avoid the presence of platform overhangs in sections, as in the case of gas turbine blades or vanes with a rectilinear blade or vane root and a rectilinear platform.

On account of the curvatures of the suction-side and pressure-side platform longitudinal edges running in the same direction, and the corresponding blade or vane root surfaces, it is no longer imperative that a platform element be fitted in between, as is required in the prior art. This also eliminates the need for the holding element for the platform element which is known from the prior art.

Moreover, more gas turbine blades or vanes than has hitherto been the case can be provided in one ring by using the gas turbine blade or vane ring according to the invention.

Advantageous configurations are given in the subclaims.

In a first advantageous configuration, the gas turbine blade or vane of the generic type has a blade or vane root surface on which all the lines of curvature running in the longitudinal direction run on an arc of a circle parallel to the bent platform longitudinal edges. As a result, it is possible for the gas turbine blade or vane to be produced particularly easily and inexpensively. Alternatively, it would also be possible for the suction-side blade or vane root surface and the pressure-side blade or vane root surface to be curved with respect to one another in such a manner that the blade or vane root becomes more pointed, i.e. with a wedge-shaped reduction in its cross section in the longitudinal direction, tapering from a leading edge end to a trailing edge end. In operation, a gas turbine blade or vane of this type would be pressed into a correspondingly shaped holding groove in a supporting structure as a result of the shear forces occurring in the hot gas and thereby axially fixed in place.

It is particularly advantageous for a suction-side or pressure-side platform protuberance, the platform width of which is approximately constant over 30% of its length running in the longitudinal direction, to project from the suction-side profile wall to the suction-side platform longitudinal edge and/or from the pressure-side profile wall to the pressure-side platform longitudinal edge. On account of the approximately constant platform width, the transition from platform to blade profile is exposed to more uniform thermal and mechanical stresses in operation. A platform configured in this manner can be cooled particularly well and uniformly and avoids platform protuberances which are uneven on account of having significantly different widths along the blade profile. Moreover, the fatigue strength can be increased, on account of the stresses now being more even.

A particularly small platform can be achieved if the suction-side and/or pressure-side platform protuberance is designed as a platform stub with a relatively short platform width. In this case, the gas turbine blade or vane is almost platform-free, which significantly simplifies its structural design. This simplification leads to a reduction in costs when designing the gas turbine blade or vane and producing it. Moreover, the material stresses which occur in the transition region between blade profile and platform and which are responsible for the premature fatigue are eliminated.

It is preferable for the gas turbine blade or vane to be designed as a gas turbine rotor blade, the blade root of which is designed in dovetail, hammer or fir tree form in cross section. Moreover, the preferably cast gas turbine blade or vane is coolable.

If separate platform elements are to be secured between two adjacent gas turbine blades or vanes of a gas turbine blade or vane ring in the same way as the gas turbine blade or vane, the platform element of the generic type has to have a platform root which is shaped in such a manner that each lateral platform root surface is convexly or concavely curved in the same way as the associated longitudinal edge.

It is particularly preferable for the platform root to be shaped in such a manner in the longitudinal direction that all the lines of curvature of the platform root surface which run in the longitudinal direction run on an arc of a circle parallel to the longitudinal edges. Consequently, the platform root is curved in the same way as the blade or vane root of the gas turbine blade or vane. Therefore, both roots have identical arcs or radii, so that each element can be mounted individually in the supporting structure.

To provide a particularly inexpensive and/or temperature- and corrosion-resistant platform element, the platform element at least partially comprises ceramic. This allows the platform cooling to be reduced, which has the effect of increasing the efficiency of a gas turbine equipped therewith.

The gas turbine blades or vanes are mounted in a supporting structure, in which there are blade or vane holding grooves, into which the blade or vane roots of the gas turbine blade or vane can be inserted, to form a gas turbine blade or vane ring; the blade or vane holding grooves correspond to the blade or vane roots of the gas turbine blades or vanes, i.e. each blade or vane holding groove is profiled in cross section and curved identically to the blade or vane root in the longitudinal or axial direction.

It is expedient for the supporting structure to be designed as a rotor disk in which the blade or vane holding grooves are provided in the outer circumference of the rotor disk, running in the axial direction of the latter.

If approximately platform-free gas turbine blades or vanes are fitted into the supporting structure, a platform holding groove, which is curved identically to the platform roots, is in each case provided between two adjacent blade or vane holding grooves in the supporting structure. Platform elements according to the invention can be pushed into these platform holding grooves in a direction of movement corresponding to their curvature, since both the longitudinal edges of the platform elements and the platform longitudinal edges of the platform of the gas turbine blade or vane and the (platform and blade or vane) roots thereof are curved in the same way and same direction.

The object relating to the use of a gas turbine blade or vane ring is achieved by the features of claim 15, in which the gas turbine blade or vane ring is preferably inserted and used in a stationary gas turbine.

On account of the approximately constant width of the suction-side and/or pressure-side platform and/or its overhangs, the platforms can be cooled more easily and more efficiently. The use of cooling air can be reduced. The cooling air which is saved can be fed for combustion in the stationary gas turbine, in order to increase efficiency. In particular if the platform element is provided as a ceramic or equipped with a ceramic thermal barrier coating, it may even be possible to dispense with the platform cooling altogether, which has the effect of increasing the efficiency of a gas turbine equipped therewith.

BRIEF DESCRIPTION OF THE DRAWINGS

The invention is explained with reference to figures, in which.

DETAILED DESCRIPTION OF THE INVENTION

Figure 1:
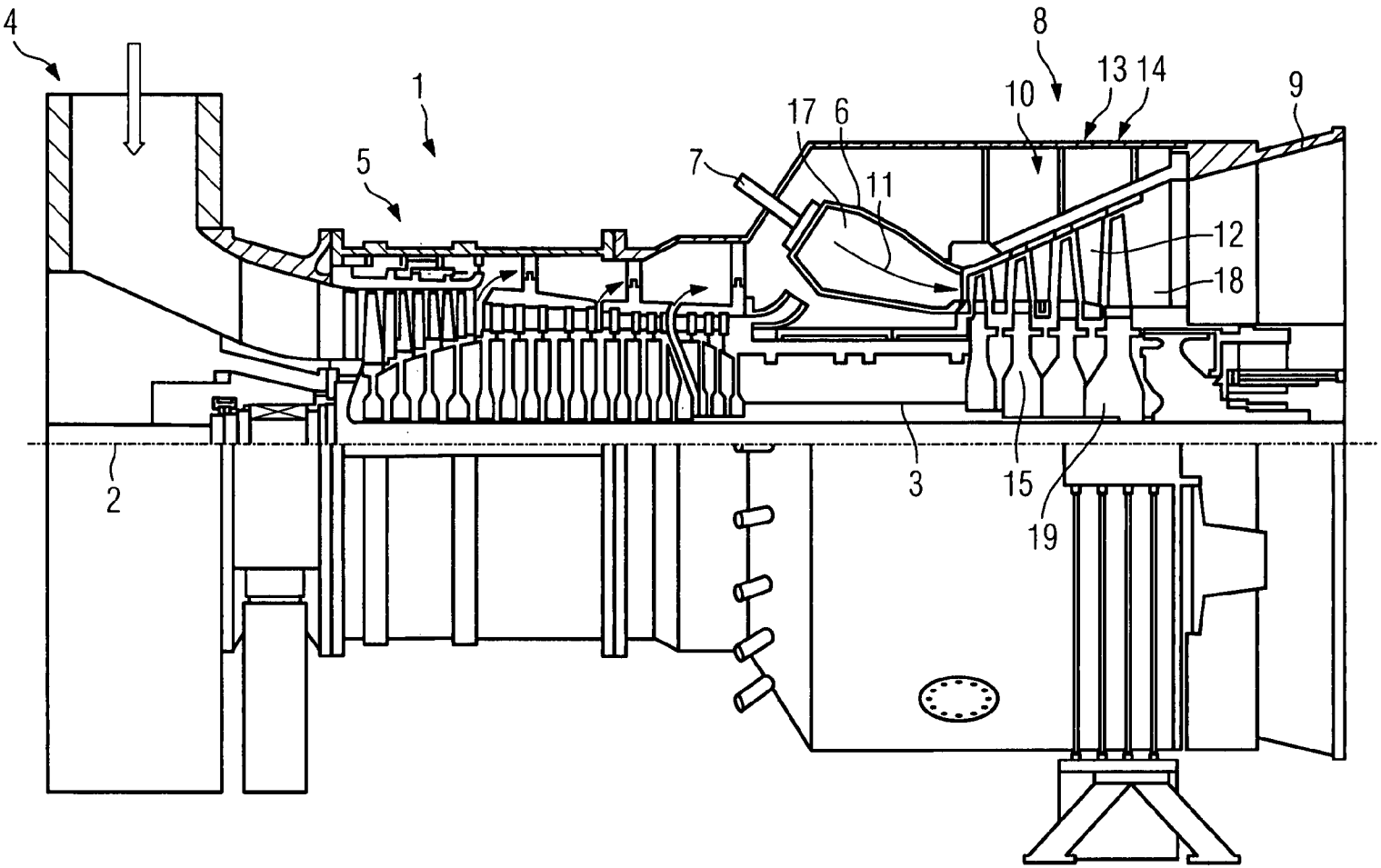
FIG. 1 shows a partial longitudinal section through a gas turbine.

FIG. 1 shows a partial longitudinal section through a gas turbine 1. In its interior, it has a rotor 3 which is mounted such that it can rotate about an axis of rotation 2 and is also referred to as the turbine rotor. An intake casing 4, a compressor 5, a toric annular combustion chamber 6 with a plurality of burners 7 arranged rotationally symmetrically with respect to one another, a turbine unit 8 and an exhaust gas casing 9 follow one another along the rotor 3. The annular combustion chamber 6 forms a combustion space 17 which is in communication with an annular hot gas duct 18. There, four successive turbine stages 10 form the turbine unit 8. Each turbine stage 10 is formed from two blade rings. As seen in the direction of flow of a hot gas 11 generated in the annular combustion chamber 6, a guide vane row 13 is in each case followed by a row 14 formed from gas turbine rotor blades 15 in the hot gas duct 18. The guide vanes 12 are secured to the stator, whereas the gas turbine rotor blades 15 of a row 14 are arranged on the rotor 3 by means of a turbine disk 19. A generator (not shown) is coupled to the rotor 3.

Figure 2:
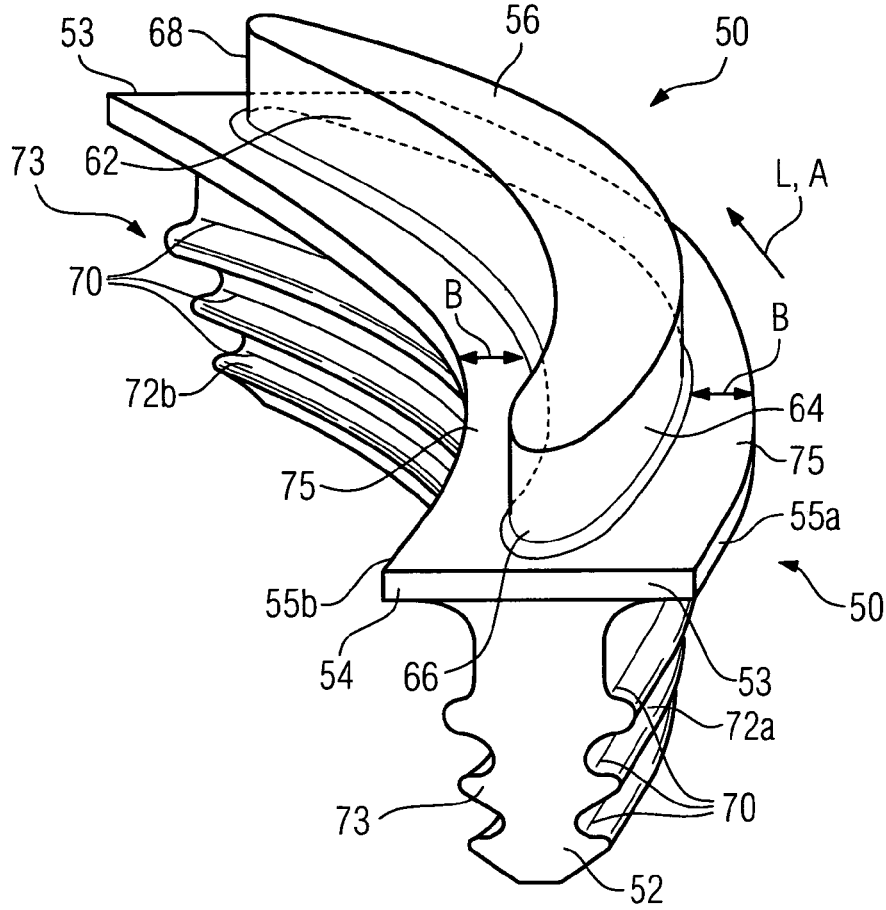
FIG. 2 shows a gas turbine blade according to the invention with a curved blade root and a curved platform.

FIG. 2 shows a gas turbine blade 50 according to the invention designed as gas turbine rotor blade with a blade root 52, on which a platform 54 and a blade profile 56 are provided in succession. The blade profile 56 is curved in the longitudinal direction L, i.e. in the axial direction A in the installed position in a gas turbine 1. For reasons of clarity, the full height of the blade profile 56 is not illustrated, but rather ends relatively close to the platform 54.

The blade profile 56 has a pressure-side profile wall 62 and a suction-side profile wall 64, which extend from a leading edge 66 of the blade profile 56 to a trailing edge 68. When the gas turbine 1 is operating, the hot gas 11 flows around the gas turbine blade 50. It flows along the profile walls 62, 64, from the leading edge 66 toward the trailing edge 68.

The platform 54 is curved in the longitudinal direction L corresponding to the curvature of the blade profile 56, and the longitudinal edges 55 of the platform 54 are not rectilinear but rather run on an arc. The suction-side platform longitudinal edge 55*a* is convexly curved, and the pressure-side platform longitudinal edge 55*b* is concavely curved. The platform 54 has a platform transverse edge 53 running transversely at the end side in the region of the leading edge 66 and in the region of the trailing edge 68, respectively.

As can be seen from the perspective illustration presented in FIG. 2, the blade root 52 is curved in the same way as the longitudinal edges 55 of the platform 54. The suction-side blade root surface 72*b* is curved convexly in the longitudinal direction, and the pressure-side blade root surface 72*a* is concave in the longitudinal direction. In the configuration shown, moreover, the blade root 52 is shaped in such a manner that all the lines of curvature 70 of the blade root surface 72, which run in the longitudinal direction L, run on an arc of a circle parallel to the platform longitudinal edges 55.

The lines of curvature 70 of the platform longitudinal edges 55 and of the blade root 52 can run on an arc of a circle, so that they can be particularly easily pushed into a supporting structure 80 (FIG. 4) successively into blade holding grooves 82.

The blade root surface 72 is to be understood as meaning the side face of the blade root 52 which runs in the longitudinal direction L. The end-side blade root surfaces 73 are excluded from this term.

On account of the curved shape of the blade root 52, it is possible to realize platform overhangs 75 which are particularly successful at reducing thermomechanical stresses and are approximately constant along the longitudinal axis L at least over 30% of the length of the platform 54 (in the longitudinal direction), both on the suction-side and on the pressure-side.

Figure 3:
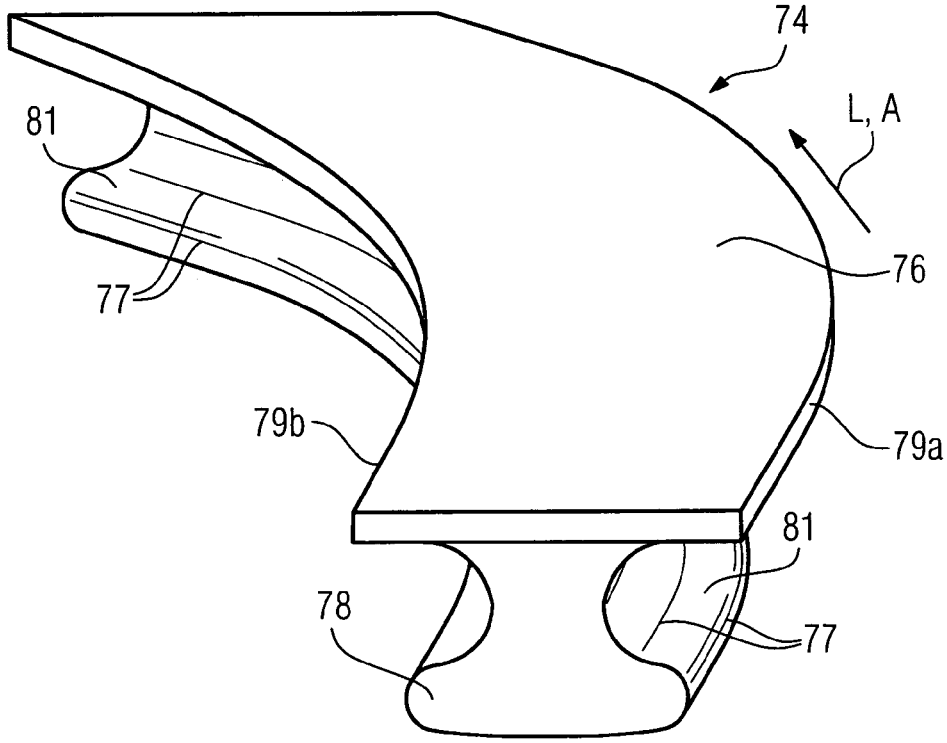
FIG. 3 shows a platform element according to the invention with a curved platform root.

FIG. 3 shows a perspective view of a platform element 74 according to the invention. The platform element 74 has a platform plate 76 and a platform root 78, both extending in the longitudinal direction L. Similarly to the platform 54 of the gas turbine blade 50, the platform plate 76 of the platform element 74 has a platform longitudinal edge 79*a* which is curved convexly in the longitudinal direction L and a concavely curved platform longitudinal edge 79*b*. The platform root 78 is curved correspondingly to the platform longitudinal edges 79 in the longitudinal direction L. Like all the lines of curvature 70 of the blade root surface 72 of the gas turbine blade 50 according to the invention which run in the longitudinal direction L, all the lines of curvature 77 of the platform root surface 81 which run in the longitudinal direction L run on an arc of a circle parallel to the longitudinal edges 79 of the platform plate 76.

Figure 4:
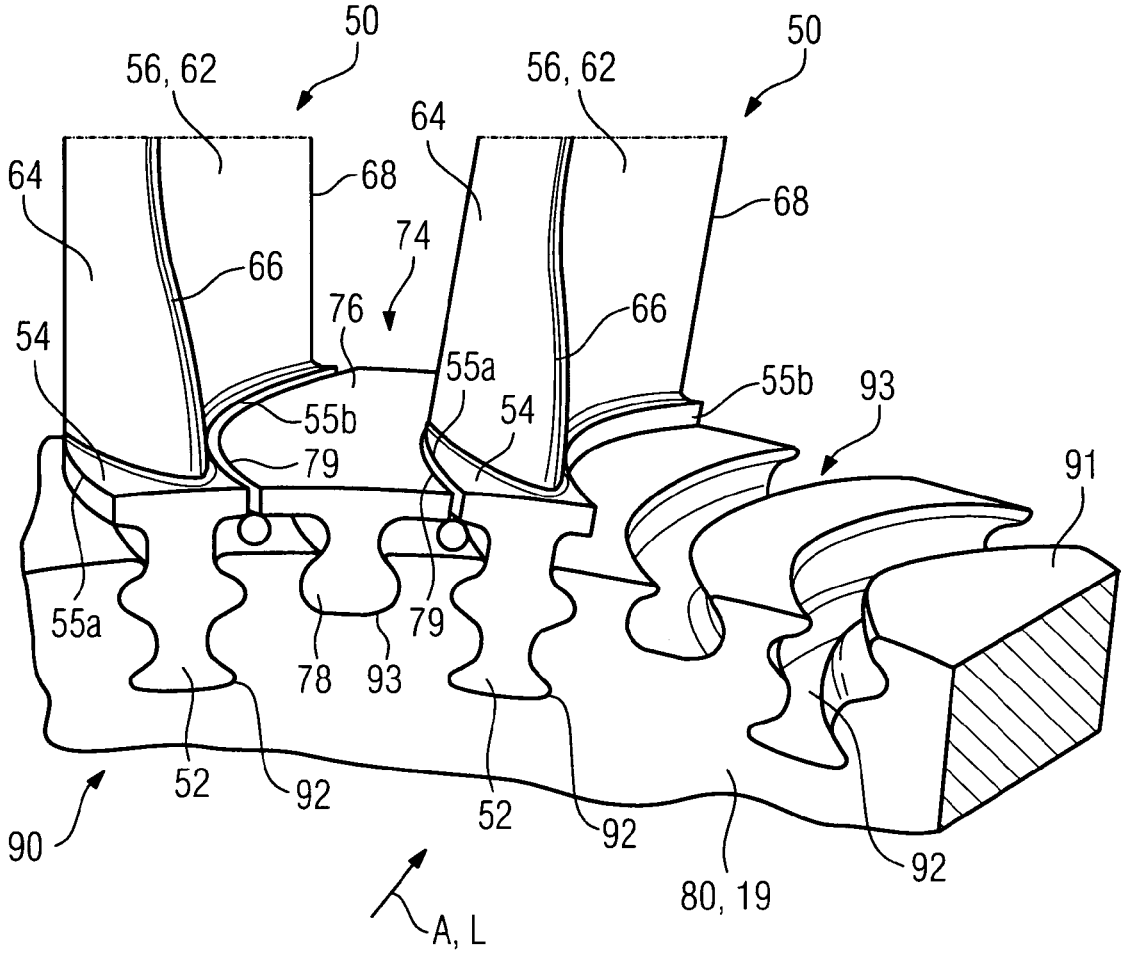
FIG. 4 shows a perspective view of an excerpt from a gas turbine blade ring.

FIG. 4 shows a perspective view of an excerpt from a gas turbine blade ring 90 according to the invention for a gas turbine 1. The gas turbine blade ring 90 is held by a supporting structure 80, in particular a rotor disk 19. Profiled holding grooves running in the axial direction A, with respect to the axis of rotation of the rotor 3, are provided at the outer circumference 91 of the rotor disk 19. The holding grooves are used to receive and secure platform elements 74 and gas turbine blades 50 according to the invention. It is preferable for the holding grooves which are provided for securing gas turbine blades 50, i.e. the blade holding grooves 92, to be profiled in fir tree form as seen in cross section, whereas the platform holding grooves 93, which are provided for holding and securing platform elements 74, are of dovetail design or other foot form, as seen in cross section. Each blade root 52 is fitted in a positively locking manner in the blade holding groove 92, and each platform root 78 is fitted in a positively locking manner in the platform holding groove 93. Both the blade holding grooves 92 and the platform holding grooves 93 are curved in the axial direction A, in such a manner that their lines of curvature of the groove surface running in the axial direction A run parallel on an arc of a circle, corresponding to the curvature of the blade root 52 and of the platform root 78.

As a result, it is possible for the gas turbine blade 50 and the platform elements 74 to be pushed individually in succession into the corresponding holding grooves in a direction of movement corresponding to their curvature.

As can be seen from FIG. 4, all the longitudinal edges with a curved profile in the axial direction A or in the longitudinal direction L can lie parallel on an arc of a circle, so that each component, both the gas turbine blade 50 and the platform element 74, of a fully fitted gas turbine blade ring 90 can be slid out of the latter in guided fashion.

Overall, on account of the curved designs of the blade root and the platform, it is in principle possible to set a more uniform platform width on both sides of the blade profile, i.e. the suction-side and the pressure-side. Therefore, the pressure-side platform overhangs and the suction-side platform overhangs can be of approximately equal size and therefore of relatively symmetrical design along the longitudinal direction of the blade profile, which avoids platform overhangs on one side and correspondingly locally varying accumulations of mass. Varying accumulations of mass have an adverse effect on the stress distributions and therefore on the service life of the gas turbine blade. Moreover, the platform overhangs which occur in sections on one side are difficult to cool, which likewise has adverse effects on the service life of the gas turbine blade. Fatigue phenomena occur over the course of time. The design with a curved blade root and with curved platform longitudinal edges allows the design of the gas turbine blade to be simplified and consequently allows more efficient cooling to be implemented, and this advantageously also allows the optionally introduction of intermediate platforms or platform elements provided between the gas turbine blades.

The invention claimed is:

1. A gas turbine blade or vane, comprising:

a blade or vane root which is profiled in cross section, extending in a longitudinal direction from a first end surface to a second end surface, and is successively adjoined by a platform; and a blade profile that is curved in the longitudinal direction and is formed by a suction-side convex profile wall and a pressure-side concave profile wall and the blade or vane root extending in the longitudinal direction of the blade profile and the platform having a suction-side, convexly bent platform longitudinal edge and a pressure-side concavely bent platform longitudinal edge, both platform longitudinal edges extending in the longitudinal direction, wherein the blade or vane root is shaped in such a manner that the blade or vane root surface along the suction-side profile wall and the blade or vane root surface along the pressure-side profile wall are respectively convexly and concavely curved in accordance with the associated platform longitudinal edge wherein a line of curvature extending along one of the blade or vane root surfaces in the longitudinal direction, from the first end surface to the second end surface along the blade or root shape, is on an arc of a circle parallel to the platform longitudinal edges.

2. The gas turbine blade or vane as claimed in claim 1, wherein the blade or vane root is shaped in such a manner in the longitudinal direction that all the lines of curvature of the blade or vane root surface which extend in the longitudinal direction extend on an arc of a circle parallel to the platform longitudinal edges.

3. The gas turbine blade or vane as claimed in claim 1, wherein a suction-side or pressure-side platform protuberance with a platform width projects from the suction-side profile wall to the suction-side platform longitudinal edge and/or from the pressure-side profile wall to the pressure-side platform longitudinal edge, which platform width is approximately constant over 30% of its length running in the longitudinal direction.

4. The gas turbine blade or vane as claimed in claim 1, wherein the suction-side and/or pressure-side platform protuberance is designed as a platform stub with a relatively short platform width.

5. The gas turbine blade or vane as claimed in claim 1, wherein the blade or vane root, as seen in cross section, is designed in dovetail, hammer or fir tree form.

6. The gas turbine blade or vane as claimed in claim 1, which is coolable and/or cast.

7. A platform element positionable between two gas turbine blades or vane rings of a gas turbine, comprising a profiled platform root and a platform plate that has a convexly curved longitudinal edge and a concavely curved longitudinal edge, such that the platform plate and the platform root extend in a longitudinal direction wherein the platform root is shaped in such a manner that at least one line of curvature on the corresponding surface extends along the longitudinal direction thereof on an arc of a circle parallel to one of the longitudinal edges.

8. The platform element as claimed in claim 7, wherein the platform root is shaped in such a manner in the longitudinal direction that all the lines of curvature of the platform root surface which run in the longitudinal direction run on an arc of a circle parallel to one of the longitudinal platform edges.

9. The platform element as claimed in claim 8, wherein the platform element at least partially comprises ceramic.

10. A supporting structure for securing gas turbine blades or vanes, comprising:

a blade or vane root which is profiled in cross section and is successively adjoined by a platform;

a blade profile that is curved in the longitudinal direction and is formed by a suction-side profile wall and a pressure-side profile wall and the blade or vane root extending in the longitudinal direction of the blade profile and the platform having a suction-side, convexly bent platform longitudinal edge and a pressure-side concavely bent platform longitudinal edge, both platform longitudinal edges extending in the longitudinal direction, wherein the blade or vane root is shaped in such a manner that the one blade or vane root surface is convex and is positioned alone the suction-side profile wall and one blade or vane root surface is concave and is positioned alone the pressure-side profile wall in accordance with the associated platform longitudinal edge; and a plurality of blade or vane holding grooves, into which the blade or vane roots of the gas turbine blades or vanes can be inserted wherein each blade or vane holding groove includes a matching curvature to receive a portion of the blade or vane root, wherein at least one line of curvature along the blade or vane root surfaces extends in the longitudinal direction on an arc of a circle parallel to one of the platform longitudinal edges.

11. The supporting structure as claimed in claim 10, wherein the supporting structure is formed by a rotor disk and in which the blade holding grooves are provided running in an axial direction in the external circumference of the rotor disk.

12. The supporting structure of claim 10 further including a platform root inserted within a platform holding groove, the platform holding groove curved identically to the platform root, both the platform root and the platform holding groove positioned between adjacent blade or vane holding grooves.

13. A gas turbine blade or vane ring for a gas turbine, having a supporting structure, comprising:

a blade or vane root which is profiled in cross section and is successively adjoined by a platform;

a blade profile that is curved in a longitudinal direction and is formed of a suction-side profile wall and a pressure-side profile wall and the blade or vane root extending in the longitudinal direction of the blade profile and the platform having a suction-side, convexly bent platform longitudinal edge and a pressure-side concavely bent platform longitudinal edge, both platform longitudinal edges extending in the longitudinal direction, wherein the blade or vane root is shaped in such a manner that a blade or vane root surface positioned along the suction-side profile wall or the pressure-side profile wall is convexly or concavely curved in accordance with the associated platform longitudinal edge; and a plurality of blade or vane holding grooves, into which the blade or vane roots of the gas turbine blades or vanes can be inserted wherein each blade or vane holding groove is curved identically to the blade or vane root and having gas turbine blades or vanes that have been pushed into the corresponding blade or vane holding grooves of the supporting structure, wherein a root is shaped in a manner that at least one line of curvature along the longitudinal direction is on an arc of a circle parallel to a platform longitudinal edge.

14. The gas turbine blade or vane ring of claim 13, having a supporting structure and having gas turbine blades or vanes, in which, as seen in the circumferential direction, platform elements are positioned in platform holding grooves located between the platform longitudinal edges of two adjacent gas turbine blades or vanes which have been pushed into the blade or vane holding grooves, with the platform plate covering the supporting structure.

15. The gas turbine blade or vane ring as claimed in claim 13, wherein the gas turbine blade or vane ring is used in a stationary gas turbine.

* * * * *